US006409613B1

(12) United States Patent
Sato

(10) Patent No.: US 6,409,613 B1
(45) Date of Patent: Jun. 25, 2002

(54) L-SHAPED PUTTER

(76) Inventor: Shozaburo Sato, 1-1-19, Hanjo, Mino (JP), 562-0044

( * ) Notice: Subject to any disclaimer, the term of this patent is extended or adjusted under 35 U.S.C. 154(b) by 0 days.

(21) Appl. No.: 09/782,038

(22) Filed: Feb. 14, 2001

(51) Int. Cl.[7] ..... A63B 53/04
(52) U.S. Cl. ..... 473/337; 473/340; 473/341
(58) Field of Search ..... 473/340, 325, 473/349, 341, 313, 251, 333, 334, 335, 336, 337, 256; D21/733, 735, 736, 738, 759

(56) References Cited

U.S. PATENT DOCUMENTS

| | | | | |
|---|---|---|---|---|
| 3,516,674 | A | | 6/1970 | Scarborough |
| 3,966,210 | A | | 6/1976 | Rozmus |
| 4,010,958 | A | | 3/1977 | Long |
| 4,290,606 | A | * | 9/1981 | Maxwell |
| 4,325,553 | A | | 4/1982 | Taylor |
| 4,330,128 | A | * | 5/1982 | Morelli |
| 4,383,690 | A | * | 5/1983 | Maxwell |
| 4,650,191 | A | * | 3/1987 | Mills |
| 4,655,459 | A | | 4/1987 | Antonious |
| 4,898,387 | A | | 2/1990 | Finney |
| 5,127,653 | A | | 7/1992 | Nelson |
| 5,186,465 | A | * | 2/1993 | Chorne |
| 5,273,282 | A | * | 12/1993 | Cannon |
| 5,409,219 | A | | 4/1995 | Saksun, Sr. |
| 5,489,097 | A | | 2/1996 | Simmons |
| 5,580,058 | A | | 12/1996 | Coughlin |
| 5,769,736 | A | | 6/1998 | Sato |
| 6,017,281 | A | * | 1/2000 | Behling |

* cited by examiner

*Primary Examiner*—Sebastiano Passaniti
(74) *Attorney, Agent, or Firm*—Wenderoth, Lind & Ponack, L.L.P.

(57) ABSTRACT

An L-shaped putter has a head 2 fixed to a tip end of a shaft 1, wherein the head 2 is formed in a planar L-letter shape including a face part 3 and a long sidewall 4 extending rearwardly from a heel-side end of the face part 3. A toe-side end of the face part 3 and an end of the sidewall 4 are each provided with a weight 6, thereby forming an oblique center-of-gravity line connecting the two weights. Thus, the center of gravity of a sweet spot can be set at a deep position toward the rear of the face, and the generation of twisting forces in the face part 3 at the time of putting is prevented to give a self diagonal retaining inertia, whereby a ball can be rolled accurately along the target line.

7 Claims, 2 Drawing Sheets

L-SHAPED PUTTER

BACKGROUND OF THE INVENTION

1. Field of the Invention

The present invention relates to a putter for golf, and more particularly to a structure of a head fixed to a tip end of a shaft.

2. Description of the Background Art

Putters for golf are formed by fixing heads of various designs to the tip end of a shaft. However, in order to perform accurate putting, the putters must be able to proceed along a straight path when the head is swung, and must reduce the generation of a twisting motion in the face of the head even if the head strikes a ball a little out of the sweet spot of the head when putting.

FIG. 3 shows an example of a head in a conventional putter, where the head 11 includes weights 13 of approximately the same weight disposed at both the toe-side end and the heel-side end of a face part 12, and a shaft 14 is fixed to a suitable position on the face part 12.

Weight distribution of the head 11 is such that the line connecting the centers of the weights 13 is located slightly rearward from the face 12*a* so as to be in parallel with the face 12*a*. The center of gravity "a" between the two weights 13 is located generally in the middle of the face part 12 on the line between the two weights 13. Here, since the relationship of the weights to the head has been mainly taken into account, addition of the weight of the shaft has been omitted.

Here, in the head 11 having a structure in which the weights 13 are disposed at both ends of the face part 12, the center of gravity of the sweet spot is located a shallow distance from the face, so that if a ball A is hit out of the sweet spot, an oblique angle is formed between the point of impact and the center of gravity between the two weights 13 (e.g., 27° as shown in FIG. 3). Therefore, problems such as generating twists in the face part 12 and providing poor direction to the ball A will arise.

Therefore, an object of the present invention is to provide an L-shaped putter in which the center of gravity is set at a deep rearward position from the face to reduce the oblique impact angle relative to the center of gravity even if the ball is putted a little out of the sweet spot. Thus, generation of twists is significantly reduced to enable putting with extremely excellent direction control.

SUMMARY OF THE INVENTION

In order to achieve the aforementioned object, a putter according to a first aspect of the present invention is an L-shaped putter having a head fixed to a tip end of a shaft. The putter is constructed in such a manner that the head is formed in a planar L-letter shape including a face part and a long sidewall extending rearwardly from a heel-side end of the face part. A toe-side end of the face part and an end of the sidewall are each provided with a weight.

A putter according to a second aspect of the present invention is constructed in such a manner that the sidewall is set to have a length smaller than the face part.

Here, by providing a weight at a rear end of the long sidewall extending rearwardly from the heel-side end of the face part and by providing a weight at a toe-side end of the face part, the center of gravity will be approximately at the center of a virtual oblique line connecting the two weights. Therefore, the center of gravity will be at a deep rear position from the sweet spot of the face so the impact angle will be minimized. Therefore, generation of twists in the face at the time of putting can be effectively prevented. In addition, the putter is swung as if pulling the weight disposed at the rear end of the sidewall at the time of putting, so that the head is given a self diagonal retaining inertia in which the face part performs movement along a straight path. As a result, the face part can easily hit the ball at a posture perpendicular to a target line, and the ball can be rolled accurately along the target line.

DETAILED DESCRIPTION OF THE INVENTION

Figure 1:
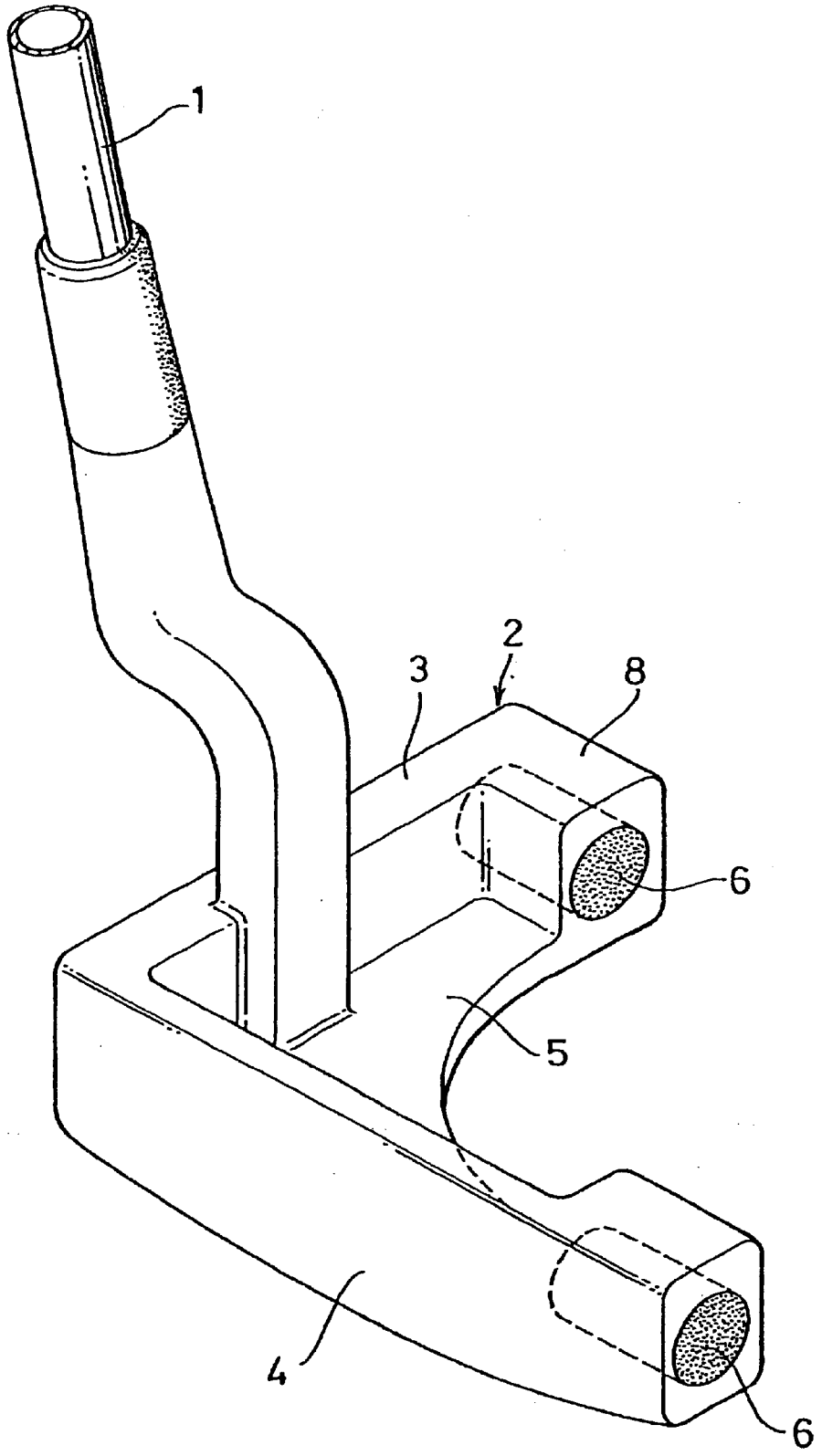
FIG. 1 is a perspective view illustrating a putter of the present invention.

Hereafter, preferred embodiments of the present invention will be described together with the examples shown in FIGS. 1 and 2.

As illustrated, a putter includes a shaft 1 and a head 2 fixed to the tip end of the shaft 1. The head 2 is formed in a planar L-letter shape with a face part 3 having a ball-striking face 3*a* and having a comparatively small thickness and being light. A long sidewall 4 extends rearwardly from the heel-side end of the face part 3 in a perpendicular orientation with respect to the face part 3. Further, the bottom portion 5 is provided at a lower part extending from the toe-side end of the face part 3 to the rear end of the long sidewall 4. A first weight 6 is provided at the toe-side end of the face part 3, and a second weight 6 is provided at the end of the heel-side end sidewall 4. Thus, the second weight is located further behind the ball-striking face 3*a* than the first weight.

A mark 7 showing a sweet spot is imprinted at the position of the sweet spot on an upper surface of the face part 3. The sidewall 4 has a slightly smaller length than the face part 3. A short toe-side wall 8 parallel to the sidewall 4 is disposed to protrude rearwardly at the toe-side end of the face part 3, and the weight 6 is inserted and fixed in a hole disposed in the toe-side wall 8. The rear end of the sidewall 4 is formed to have a slightly increased width in an inward direction, and the weight 6 is inserted and fixed in a hole disposed in the rear end. These weights 6 are formed of a heavy metal such as lead.

The putter of the present invention is constructed as described above, and is used by gripping the grip of the shaft 1 and allowing the sweet spot to face the ball A so that the face part 3 of the head 2 will be perpendicular to the target line, whereafter an ordinary putting motion is carried out.

The head 2 includes a long sidewall 4 disposed at the heel-side end of the face part 3, and a short toe-side wall 8 disposed at the toe-side end of the face part 3. Weights 6, 6 are provided respectively in the rear end of the sidewall 4 and in the end of the toe-side wall 8. Therefore, lines connecting the sweet spot of the face part 3 and the first and second weights 6, 6 are in a planar triangular relationship, and this relationship allows the center of gravity of the sweet spot to be positioned well to the rear of the ball-striking face 3*a* of face part 3, whereby generation of twisting forces (i.e., torque) in the face part 3 when putting can be effectively prevented. Also, the weight 6 disposed in the rear end of the sidewall 4 induces a swinging movement in the front-and-rear direction when putting, thereby retaining the face part 3 to move along a straight path so as to give a self diagonal retaining inertia to the head 2. Therefore, the face part 3 in the front hits the ball while in a posture perpendicular to the target line, whereby the ball can be rolled accurately along the target line to improve the direction control of putting.

At this time, the weight 6 in the long sidewall 4 is positioned so as to be extremely distant (within an allowed range) toward the rear of the face part 3. Therefore, the weight 6 induces a swinging movement in the front-and-rear direction during the putting movement, thereby retaining the straight movement characteristic of the face part 3.

Next, generation of twist phenomenon in the conventional putter shown in FIG. 3 and in the putter of the present invention will be described.

Figure 3:
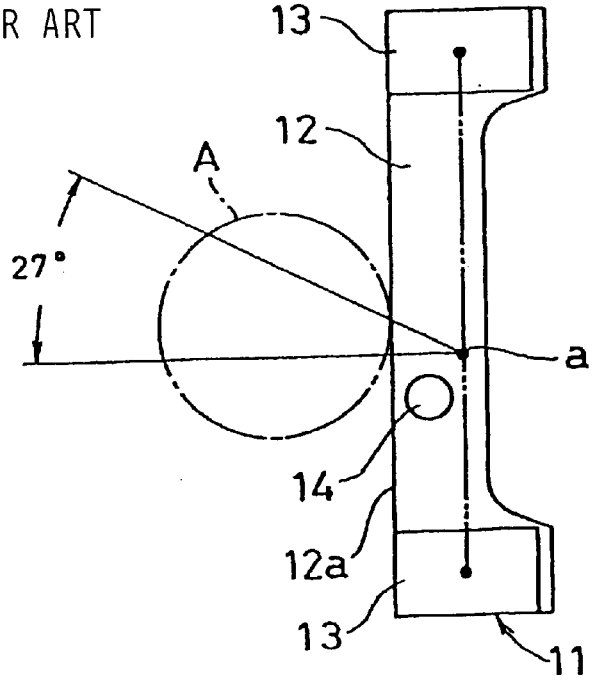
FIG.3 PRIOR ART
FIG. 3 is a plan view illustrating a conventional putter.

Referring to FIG. 3, assuming the center length between the two weights 13 of the face part 12 of the conventional putter to be about 95 mm, and the length of the two weights 13 in the front-and-rear direction to be 25 mm, the center line between the two weights 13 can be assumed to be at a position about 12.5 mm behind the sweet spot, and the center of gravity "a" of the head 11 will be at the point of intersection of this center line and the center line of the sweet spot.

When the ball A is putted at a position shifted away from the sweet spot by a relatively small distance of 5 mm, the ball A is obliquely impacted by the face at an angle formed with the center of gravity that is equal to the shift, whereby the oblique impact angle from the point of contact on the face 12*a* to the center of gravity will be about 27°, and the impact causes a twisting force which acts on the face part 3 to a great extent.

Figure 2:
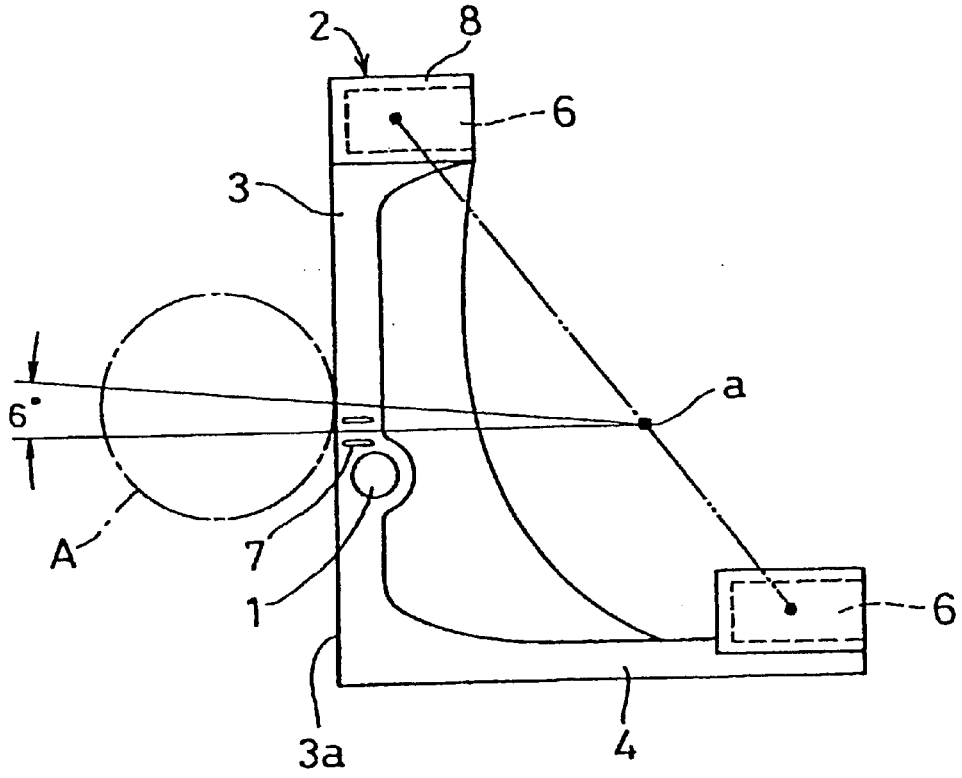
FIG. 2 is a plan view of the putter of FIG. 1.

Referring to FIG. 2, the head 2 in the putter of the present invention has a face part 3 having a length of 95 mm and a sidewall 4 having a length of 90 mm. Further, weights 6, 6 having the same weight as the weights 13 of the conventional putter are mounted in the rear end of the sidewall 4 and in the toe-side end of the face part 3.

The center of gravity "a" of the head will be at a point of intersection of an oblique virtual center-of-gravity line connecting the centers of the two weights 6, 6 and the center line of the sweet spot, whereby the distance of the center of gravity "a" from the face will be about 50 mm.

When the ball A is putted at a position shifted away from the sweet spot by a relatively small distance of 5 mm in the same manner as in the above-described conventional example, the oblique impact inclination angle from the point of impact on the face 3*a* to the center of gravity will be about 6°, which is about 1/4.5 of the oblique inclination angle of the conventional putter. The smaller the oblique impact inclination angle is, the smaller the impact of the twisting force generated in the face part 3 will be. Therefore, the head 2 in the putter of the present invention provides reduced generation of twisting forces in the face part 3 at the time of putting, whereby an accurate putting stroke can be carried out. When the ball hits the center of the sweet pot, it gets good results.

As described above, according to the present invention, the head is formed in a planar L-letter shape including a face part and a long sidewall extending rearwardly from the heel-side end of the face part, and a weight is provided in both the toe-side end of the face part and in the end of the sidewall. Therefore, the center of gravity of the sweet spot can be set at a deep position in the rear of the face, and this position of the center of gravity can effectively prevent generation of twisting forces in the face part at the time of putting.

Moreover, since the weight is disposed in the rear end of the long sidewall, the positional relationship between the face part, the shaft and the rearwardly positioned weight allows the putt swinging movement of the head to be just like drawing (pulling) a manually drawn vehicle. This allows the putt swing of the head to move along a straight line to give a self diagonal retaining inertia, whereby the ball-striking face of the face part hits the ball in a posture perpendicular to the target line, and the ball can be rolled accurately along the target line. This leads to a reduction in the total number of putts necessary in a round of golf.

What is claimed is:

1. A golf putter comprising:

a shaft; and a head attached to an end of said shaft, said head including:

a face part having a ball-striking face, a toe-side end, and a heel-side end, said shaft being connected to said face part of said head;

a sidewall extending from said heel-side end of said face part in a rearward direction with respect to said ball-striking face;

a first weight located at said toe-side end of said face part; and a second weight located at a rear end of said sidewall such that said second weight is located a greater distance behind said ball-striking face than said first weight.

2. The golf putter of claim 1, wherein said sidewall has a length smaller than a length of said face part.

3. The golf putter of claim 1, wherein said face part, said sidewall, said first weight, and said second weight are co-planar.

4. The golf putter of claim 1, wherein said sidewall is perpendicular to said face part.

5. The golf putter of claim 1, wherein said head further includes a bottom portion extending from said toe-side end of said face part to said rear end of said sidewall.

6. The golf putter of claim 1, wherein said first weight and said second weight each comprise a lead weight inserted into a hole in said toe-side end of said face part and said rear end of said sidewall, respectively.

7. The golf putter of claim 1, wherein said head includes a sidewall extending from said toe-side end of said face part, said sidewall extending from said heel-side end of said face part having a greater length than said sidewall extending from said toe-side end of said face part.

* * * * *